US009743708B2

(12) United States Patent
Chaigne

(10) Patent No.: US 9,743,708 B2
(45) Date of Patent: Aug. 29, 2017

(54) SPORTS BOOT

(71) Applicant: SALOMON S.A.S., Metz-Tessy (FR)

(72) Inventor: Jerome Chaigne, Gruffy (FR)

(73) Assignee: SALOMON S.A.S., Metz-Tessy (FR)

( * ) Notice: Subject to any disclaimer, the term of this patent is extended or adjusted under 35 U.S.C. 154(b) by 35 days.

(21) Appl. No.: 14/735,520

(22) Filed: Jun. 10, 2015

(65) Prior Publication Data

US 2015/0359292 A1 Dec. 17, 2015

(30) Foreign Application Priority Data

Jun. 11, 2014 (FR) ..... 14 01326

(51) Int. Cl.
*A43B 5/04* (2006.01)
*A43B 5/00* (2006.01)

(52) U.S. Cl.
CPC ..... *A43B 5/0454* (2013.01); *A43B 5/002* (2013.01); *A43B 5/047* (2013.01); *A43B 5/048* (2013.01);
(Continued)

(58) Field of Classification Search
CPC ..... A43B 5/0747; A43B 5/047; A43B 5/0466; A43B 5/0452; A43B 5/0456; A43B 5/0454; A43B 5/048
(Continued)

(56) References Cited

U.S. PATENT DOCUMENTS 4,718,180 A * 1/1988 Hilgarth ..... A43B 5/0433 24/68 SK
5,005,303 A * 4/1991 Bonaventure ..... A43B 5/04 36/118.7
(Continued)

FOREIGN PATENT DOCUMENTS

AT 386 511 B 9/1988
CH EP 0514762 A2 * 11/1992 ..... A43B 5/0456
(Continued)

OTHER PUBLICATIONS

Translation of EP 0514762 A2, Walkhoff, Klaus, Skischuh, May 14, 1994, translated Mar. 23, 2016 via Google translate.*

*Primary Examiner* — Clinton T Ostrup
*Assistant Examiner* — Heather Mangine
(74) *Attorney, Agent, or Firm* — Greenblum & Bernstein, P.L.C.

(57) ABSTRACT

Sports boot having a lower portion to surround a user's foot, an upper portion to surround the user's lower leg and movable in relation to the lower portion, and mechanisms blocking the lower portion in relation to the upper portion. The upper portion includes disjointed lateral and medial portions, each rotationally articulated with the lower portion. The blocking mechanisms include an element movable in relation to the lower portion between a blocking position, in which the blocking mechanisms at least partially lock upper portion movement in relation to the lower portion, and an unblocking position in which the blocking mechanisms allow upper portion free movement in relation to the lower portion. When the blocking element is in the unblocking position, the blocking mechanisms allow translational movement of the lateral portion in relation to the medial portion at least along a direction perpendicular to an outsole of the boot.

20 Claims, 5 Drawing Sheets

(52) U.S. Cl.
CPC ..... *A43B 5/0466* (2013.01); *A43B 5/0474* (2013.01); *A43B 5/0496* (2013.01)

(58) Field of Classification Search
USPC ..... 36/118.1, 118.2, 118.3, 118.7, 118.8, 36/118.9, 50.5
See application file for complete search history.

(56) References Cited

U.S. PATENT DOCUMENTS

| | | | | |
|---|---|---|---|---|
| 5,678,331 | A * | 10/1997 | Bonaventure ..... | A43B 5/0443 36/117.1 |
| 8,074,380 | B2 | 12/2011 | Narajowski et al. | |

FOREIGN PATENT DOCUMENTS

| | | | |
|---|---|---|---|
| EP | 0 406 212 | A2 | 1/1991 |
| EP | 1 880 623 | A1 | 1/2008 |
| EP | 2 057 912 | A1 | 5/2009 |

* cited by examiner

Fig: 4a
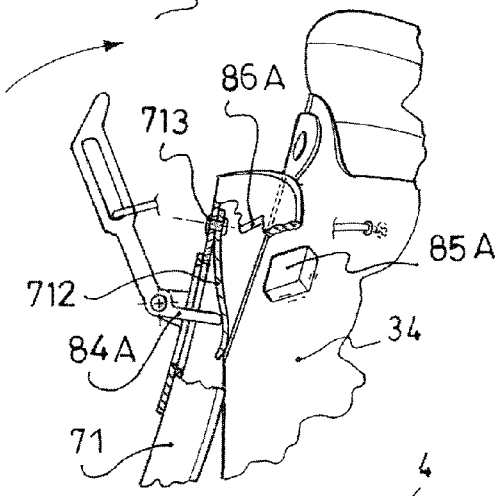
Fig: 3
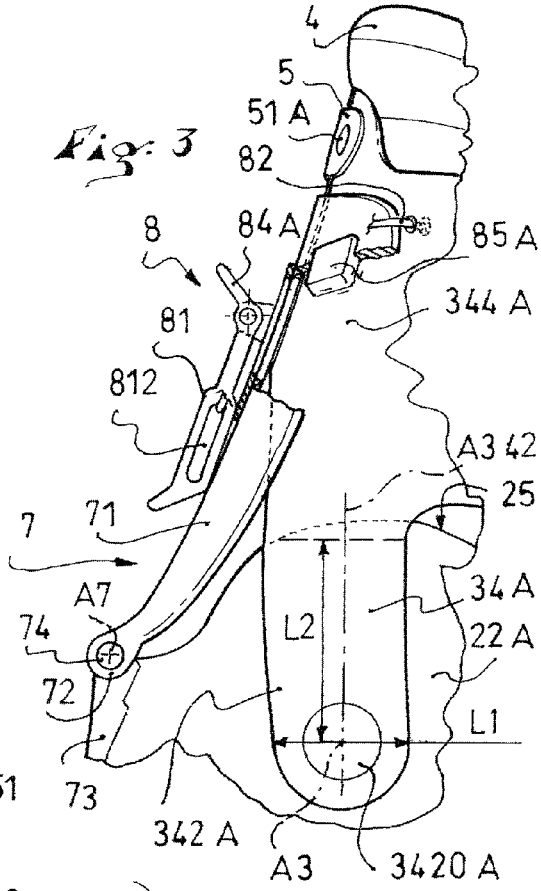
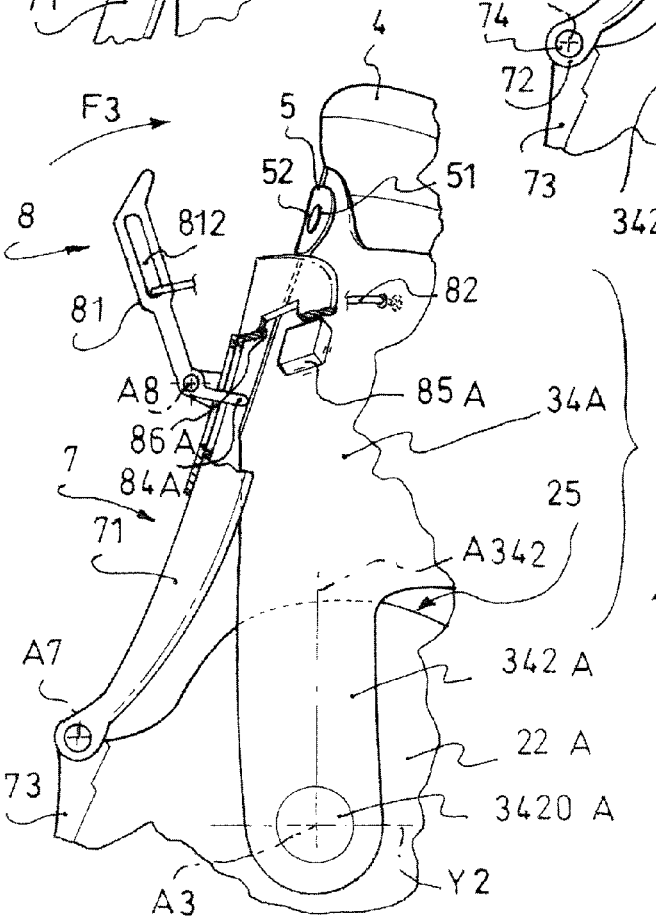
Fig: 4

SPORTS BOOT

CROSS-REFERENCE TO RELATED APPLICATION

This application is based upon French Patent Application No. FR 14/01326, filed Jun. 11, 2014, the disclosure of which is hereby incorporated by reference thereto in its entirety, and the priority of which is claimed under 35 U.S.C. §119.

BACKGROUND

1. Field of Invention

The present invention relates to a sports boot, in particular a sports boot designed for skiing, mountaineering, and walking.

2. Background Information

To ensure user safety and provide optimum comfort during skiing, ski boots generally have a rigid shell within which a soft inner liner is inserted. The shell generally comprises a plurality of elements made of a relatively rigid composite plastic material, and the liner is constructed by assembling a plurality of foam or fabric panels.

The document EP-A-0 406 212 discloses an alpine ski boot comprising a lower portion provided to envelop the foot of the user, and an upper portion, or collar, provided to surround the lower leg. The collar is rotationally articulated with the lower portion about an axis corresponding to the articulation axis of the ankle of the user. The rearward rotation of the collar is locked so as to enable the rearward support of the legs of the skier during skiing. The boot allows for a slight forward rotation of the collar in order to enable the user to lean forward.

In alpine skiing, the user must sometimes walk a short distance to reach the top of a ski slope, when the ascent is carried out by cable car, for example. The substantial rigidity of the boot according to the document EP-A-0 0 406 212 makes it difficult to walk because the movements of the ankle are blocked by the boot.

Touring skis are equipped with bindings allowing the boot to pivot around its front end, so as to enable the heel to be lifted away from the ski. This movement involves longitudinal flexion and extension of the ankle, which is not allowed by alpine ski boots.

Touring ski boots are equipped with a mechanism for unlocking the rearward rotation of the collar, in order to facilitate the approach by allowing longitudinal flexion and extension of the ankle. However, the collar is not free to pivot laterally, which blocks the lateral flexional movements of the ankle, called inversion and eversion. Thus, touring ski boots are not adapted for the approach, in which the skier takes off his or her skis and moves on rough terrain, or for mountain climbing. Furthermore, touring ski boots are not any more adapted for the ascent phases on sloping zones which require a lateral inclination of the boot.

In this regard, the document EP-A-0 406 212 describes a mechanism for adjusting the lateral inclination, or "canting", of the collar in relation to the lower portion of the boot, depending on the morphology of the legs of the skier. This adjustment is done prior to skiing and is not modified during use of the boot. The canting adjustment is not easy to achieve and often requires a tool.

In EP-A-0 406 212, a free position is provided, in which the collar can freely tilt laterally. However, the angular amplitude of this movement is limited to a few degrees, and friction makes lateral inclination difficult. Thus, the boot according to the document EP-A-0 406 212 is not adapted to allow an easy lateral flexional movement of the ankle during skiing or during walking.

Further, EP-A-1 880 623 discloses a ski boot having an increased lateral flexion amplitude. In the area of the ankle articulation, the boot comprises two ball-type connections. Two independent blocking mechanisms block the longitudinal flexion and extension of the ankle, on the one hand, and block the lateral flexion, on the other hand. This device is relatively heavy and complex and requires a bulky and projecting coupling plate. In addition, the collar of the boot cannot simultaneously tilt longitudinally and laterally, which limits the movements of the ankle.

SUMMARY

The foregoing drawbacks are ones that the invention more particularly remedies by providing an improved sports boot for the practice of alpine skiing, ski touring, and mountaineering. The invention provides a boot having a collar that has great freedom of movement, that is, an increased freedom of movement, in relation to the lower portion of the boot. The invention also provides a boot sufficiently lightweight to enable walking, mountaineering, or climbing, while being sufficiently rigid to ensure that the leg is properly held during skiing, particularly for support of the leg against the rear of the collar.

To this end, the invention relates to a sports boot comprising:

- a lower portion designed to surround the foot of a user;
- an upper portion provided to surround the lower leg of the user and movable in relation to the lower portion;
- mechanisms for at least partially blocking the movements of the lower portion in relation to the upper portion;
- the upper portion comprising a lateral portion and a medial portion, disjointed and each rotationally articulated with the lower portion;
- the blocking mechanisms including a blocking element, movable in relation to the lower portion between a blocking position, in which the blocking mechanisms at least partially lock the movements of the upper portion in relation to the lower portion, and an unblocking position, in which the blocking mechanisms allow free movements of the upper portion in relation to the lower portion; and
- when the blocking element is in the unblocking position, the blocking mechanisms allow a relative translational movement of the lateral portion with respect to the medial portion, at least along a direction perpendicular to the outsole of the boot.

With the boot of the invention, the collar is free to tilt laterally and longitudinally, simultaneously, in relation to the lower portion when the blocking element is in the unblocking position. In addition, blocking the collar is easily done by means of the blocking element. Furthermore, each portion of the collar is articulated with the lower portion about a transverse axis perpendicular to a median plane of the boot, which makes it possible to anatomically reproduce the longitudinal flexional movement of the ankle. In addition, the relative translational movement of the portions of the collar in relation to one another enables the lateral tilting of the collar in relation to the lower portions, in the unblocking position, due to the inherent flexibility of the portions of the collar, which work in flexion.

According to advantageous but non-essential aspects of the invention, a sports boot of this type can include one or more of the following characteristics, taken in any technically feasible combination:

The boot comprises mechanisms for connecting the lateral portion with the medial portion and, in rear view, a quadrilateral-shaped contour comprising vertices defined by:

- a first articulation arrangement of the lateral portion with the lower portion,
- a second articulation arrangement of the medial portion with the lower portion;
- a third articulation arrangement of the connecting mechanisms with the lateral portion;
- a fourth articulation arrangement of the connecting mechanisms with the medial portion;
- and, in the unblocking position and during a lateral flexional movement of the upper portion in relation to the lower portion, about an axis generally parallel to a longitudinal axis of the sports boot, the values of the angles of the quadrilateral vary.

The connecting mechanisms comprise a band that is articulated at the lateral portion or the medial portion, respectively, by the third or fourth articulation arrangement.

The connecting mechanisms are arranged in a rear zone of the sports boot.

When the blocking element is in the unblocking position, the following movements are simultaneously allowed:

- a longitudinal flexional movement of the upper portion in relation to the lower portion about a first axis perpendicular to a longitudinal median plane of the sports boot; and
- a lateral flexional movement of the upper portion in relation to the lower portion about a second axis generally parallel to a longitudinal axis of the sports boot;
- an angular amplitude of the lateral flexional movement, on both sides of the longitudinal median plane, is between 10° and 30°, or, with regard to a particular specific value, on the order of 20°;
- the lateral portion and medial portion each comprise a bearing rotationally articulated with a lateral side of the lower portion;
- the bearings are elongated, and a ratio having a minimum length of each bearing as the denominator, and a maximum width of the bearing as the numerator, is between 1.2 and 2.5, or, with regard to a particular value, between 1.4 and 2.0;
- the sports boot comprises mechanisms for locking the blocking element in the blocking position, and the blocking element comprises two openings each receiving, in the blocking position, a pin fitted on the lateral portion or the medial portion and belonging to the locking mechanisms;
- the locking mechanisms comprise a lever articulated with the blocking element, and a cable cooperating with the lever, the ends of which are fixed to the lateral and medial portions, and, in the blocking position, the lever exerts tension on the cable;
- the lever comprises a projecting portion forming a cam which, when the lever is folded in an unlocking position, pushes the lateral and medial portions and releases the pins out of the openings;
- each portion envelops the lower leg on an angular sector greater than or equal to 90°;
- the portions jointly surround the lower leg on an angular sector greater than or equal to 300°.

BRIEF DESCRIPTION OF DRAWINGS

The invention will be better understood and other aspects thereof will become more apparent from the following description of a sports boot according to the invention, provided only by way of example and with reference to the annexed drawings, in which:

FIG. 3 is a view, on a larger scale, of the detail III in FIG. 1;

FIG. 4 is a view similar to FIG. 3, during the unblocking;

FIG. 4*a* is a view of a constructional variation;

DETAILED DESCRIPTION

Figure 1:
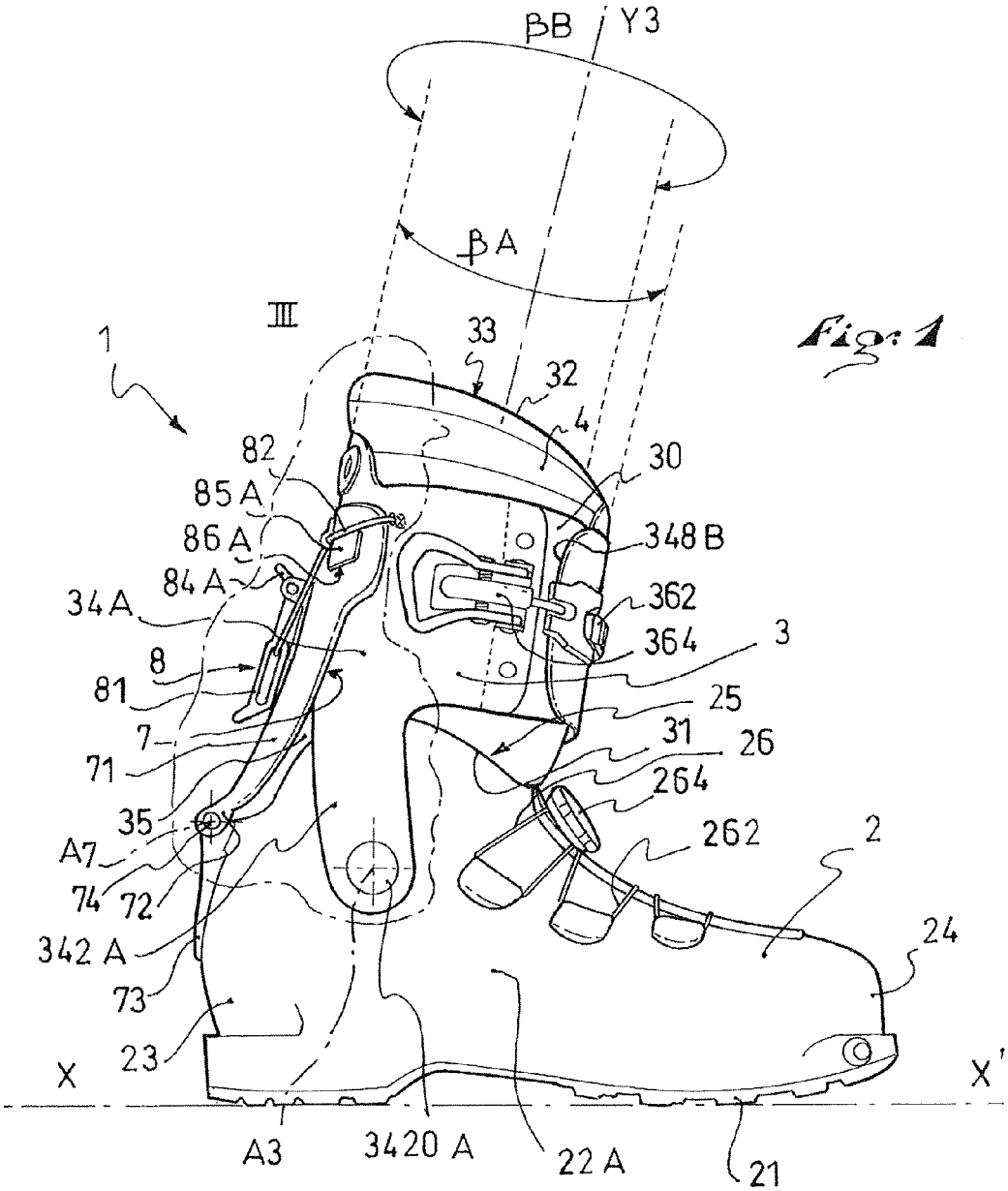
FIG. 1 is a side view of a sports boot according to the invention, in a blocking position.

FIGS. 1 to 7 show a sports boot 1, particularly designed for skiing, ski touring, mountaineering, and walking. In the particular illustrated example, the boot is a touring ski boot, that is, a boot designed for touring.

In the following description, the terms "upper", "lower", "front", "rear", "vertical" and "horizontal" are defined in relation to the orientation of the boot 1 in FIG. 1, which corresponds to a use of the boot 1 in which the outsole 21 rests on a flat and horizontal surface.

The boot 1 comprises a lower portion, or shell base 2, designed to surround and envelop the foot of a user. An upper portion of the boot 1, or collar 3, is provided to surround and envelop the lower leg of the user. The collar 3 is movable in relation to the lower portion 2.

The lower portion 2 extends lengthwise along a longitudinal axis X-X' of the boot 1, between a heel 23 located at the rear of the boot 1, and a tip 24, or front end, located at the front of the boot 1. The lower portion 2 includes generally vertical lateral sides 22A and 22B extending from the sole 21. The lateral sides 22A and 22B, together with the sole 21, define a cavity provided for receiving the foot of the user. An upper zone of the lower portion demarcates an opening 25, defined by an upper edge, provided for insertion of the user's foot.

The lower portion 2 and collar 3 comprises respective rigid shells 20 and 30. The shells 20 and 30 are generally made of synthetic materials, that is, plastic or composite material, for example, and the liner 4 is generally constructed by assembling a plurality of foam or fabric panels.

First tightening mechanisms 26, for example laces 262 and a tightening element 264, which make it possible to tighten the lateral sides 22A and 22B against one another to firmly hold the foot of the user in the lower portion 2. Alternatively, hooks or any other tightening mechanism can be used to replace or supplement the laces 262 and the tightening element 264.

The collar 3 extends height-wise between a lower edge 31 demarcating an aperture that opens out into the opening 25 of the lower portion 2, and an upper edge 32 demarcating an opening 33 provided for insertion of the user's foot in the boot 1. In the area of the opening 33, the liner 4 projects outside of the shell 30 for reasons of comfort.

The collar 3 includes a first lateral portion 34A and a second medial portion 34B, which upwardly extend the lateral sides 22A and 22B of the lower portion 2.

The portions 34A and 34B are two distinct, otherwise disjointed mechanical elements. The elements 34A and 34B are separated by a slit 35 of the collar 3 located above the heel, in the rear portion of the boot 1, through which the liner 4 is visible. In the blocking position, and in the unblocking position when the collar 3 extends lengthwise perpendicular to the sole 21, the portions 34A and 34B extend on respective opposite sides of a vertically oriented median plane M of the boot 1, which passes through the longitudinal axis X-X' and divides the boot 1 into a lateral portion and a medial portion.

Each portion 34A and 34B is rotationally articulated with a side 22A or 22B of the lower portion 2, in the area of a zone corresponding to the malleolus of the user, by means of an elongated rivet 3420A or 3420B forming first and second articulation arrangements. Each portion 34A and 34B comprises a lower portion, or bearing 342A or 342B, rotationally articulated with the lower portion 2 about an axis A3 generally horizontal and perpendicular to the median plane M. The axis A3 is common to both bearings 342A and 342B. Each of the bearings 342A and 342B extends lengthwise along a line that has a radial direction in relation to the axis A3. For example, FIGS. 3 and 4 illustrate such a radial line A342 along which bearing 342A extends.

In the example shown, the bearings 342A and 342B are rectilinear. Alternatively, they can be curved. In this case, the line A342 is also curved.

Each bearing 342A is extended upwardly by an upper portion 344A or 344B of the corresponding portion 34A or 34B of the collar 3, which is provided to partially surround the lower leg.

The portions 34A and 34B are formed from thin and slightly flexible and elastic plates, such that the space requirement of the boot 1 is not penalized.

Second tightening mechanisms 36 are provided for tightening the collar 3 on the lower leg of the user. The second tightening mechanisms 36 comprise a notched band 362, such as a metal band, fixed to the upper portion 344B of the medial portion 34B, as well as a tightening hook 364, fixed to the upper portion 344A of the side portion 34A.

Each portion 34A and 34B comprises a first edge or inner edge 346A or 346B, which is parallel to the median plane M in the blocking position, and in the unblocking position when the collar 3 extends perpendicular to the sole 21. A second edge 348A or 348B of each portion 34A and 34B is opposite the first edge 346A or 346B of the corresponding portion 34A of 34B.

A maximum width L1 of each bearing 342A and 342B is measured perpendicular to the line A342. A minimum length L2 of each bearing 342A and 342B is measured along the line A342, between the axis A3 and the upper portion 344A or 344B. The length L2 is strictly greater than the width L1. A ratio, having the width L1 as the denominator and the length L2 as the numerator, is between 1.3 and 2.5, or in a more particular value, substantially equal to 1.5.

Figure 5:
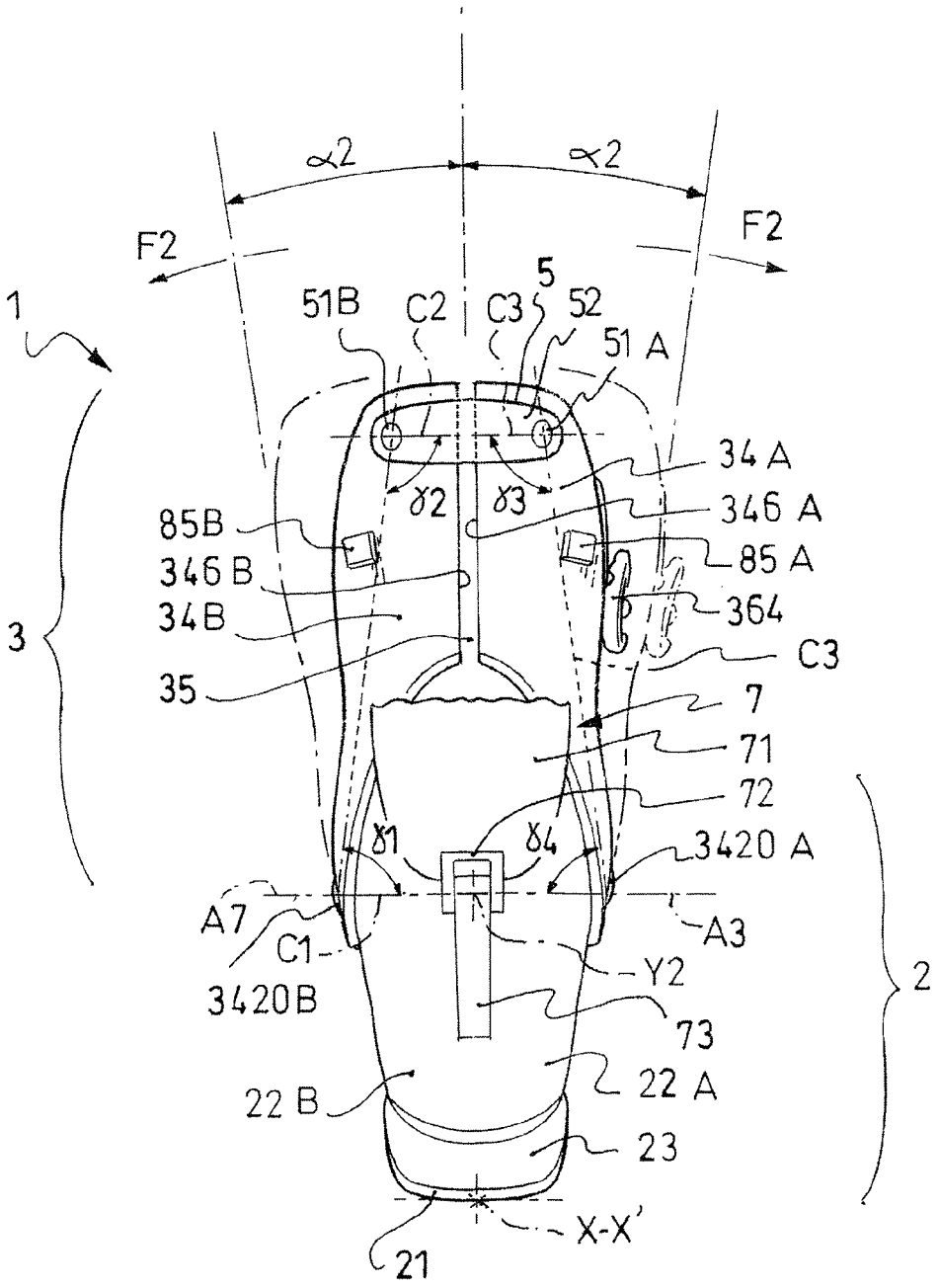
FIG. 5 is a partial rear view of the boot of FIG. 1, in the unblocking position.
Figure 7:
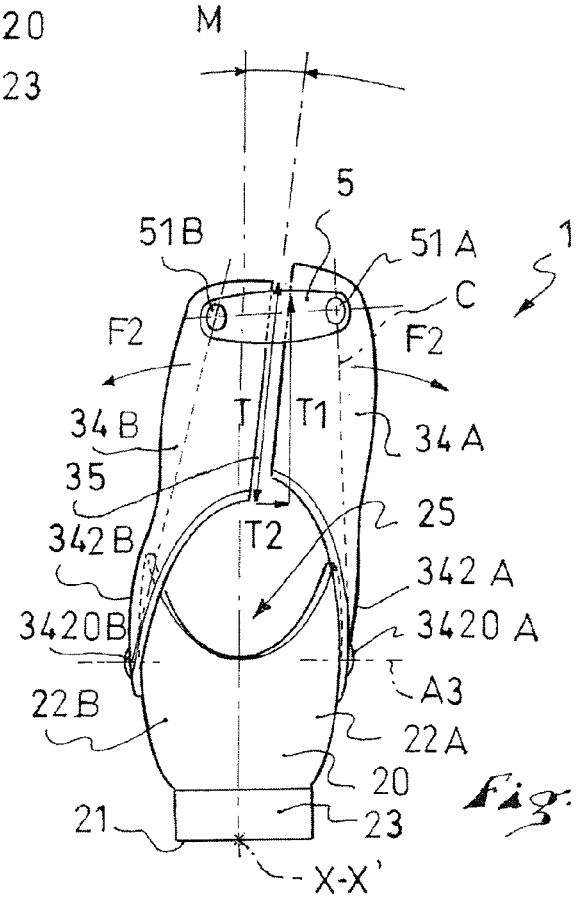
FIG. 7 is a view similar to FIG. 6, in the unblocking position.

Such a ratio between the dimensions L1 and L2 confers a flexibility specific to each portion 34A and 34B, thereby enabling a lateral flexional movement F2 of each portion 34A and 34B, perpendicular to the median plane M, as indicated in FIGS. 5 and 7.

The upper portion 344A and 344B of each portion 34A and 34B is wider than the bearings 342A and 342B and envelops the lower leg of the user on an angular sector βA or βB, greater than or equal to 90°. The angles βA and βB are measured about an axis Y3, which is a longitudinal axis of the collar 3 corresponding to the central axis of the cylindrical envelope demarcating the outer shape of the collar 3, between the edges 346A and 348A or 346B and 348B of the portion 34A or 34B. The upper portions 344A and 344B of the portions 34A and 34B, in a particular embodiment, jointly surround the lower leg on an angular sector greater than or equal to 300°.

In the example shown in the drawing figures, the upper portions 344A and 344B jointly surround the lower leg over approximately 360°. The angular sector βA of the lateral portion 34A is approximately equal to 180°, and the angular sector βB of the medial portion 34B is approximately equal to 200°. The upper portion 344B of the medial portion 34B comprises a portion that overlaps the upper portion 344A of the lateral portion 34A over approximately 20°, to enable efficient and comfortable tightening of the lower leg of the user.

Connecting mechanisms 5 mechanically connect the lateral portion 34A to the medial portion 34B. The connecting mechanisms 5 are assembled in the area of the upper ends of the portions 34A and 34B and comprise an elongated rigid plate 52 oriented generally perpendicular to the median plane M, each end of which is rotatably mounted on the upper portion 344A or 344B of one of the portions 34A and 34B, so as to allow pivoting of the plate 52 against the portions 34A and 34B. For example, the plate 52 is assembled to each portion 34A and 34B by means of two rivets 51A and 51B each extending through the plate 52 and one of the portions 34A and 34B and forming third and fourth articulation arrangements of the portions 34A and 34B with the plate 52.

The boot 1 includes mechanisms for at least partially blocking the movements of the lower portion 2 with respect to the collar 3. These blocking mechanisms comprise a blocking element 7 including a backplate 71 movable between a blocking position, shown in FIGS. 1, 3 and 6, and an unblocking position, shown in FIGS. 2, 4, 5 and 7. The blocking element 7 is not shown in FIGS. 6 and 7.

The backplate 71 is rotationally articulated with the lower portion 2, above a zone corresponding to the heel of the user. The backplate 71 is curved so as to partially surround the rear portion of the lower leg. The articulation arrangement of the backplate 71 with the shell base 2 includes a bearing 72 fixed to the lower end of the backplate 71, as well as a lug 73 fixed to the shell base 2. These elements are not illustrated in FIGS. 6 and 7. The lug 73 is provided with an opening for passage of a shaft or pin 74 supported by the bearing 72. The shaft 74 is oriented along an axis A7 generally perpendicular to the median plane M. Thus, the blocking member 7 is rotationally articulated in relation to the shell base 2 about the axis A7.

Optionally, an additional tightening strap, not shown, can be fixed to each portion 34A and 34B of the collar 3 by means of rivets 51A and 51B. The strap is designed to surround the collar 3 and is provided with tightening mechanisms, such as buckle and self-gripping strips, such as a hook and loop fasteners.

The blocking element 7 is arranged outside of the shells 20 and 30 of the lower portion 2 and of the collar 3, with respect to the inner volume for receiving the foot of the user. The shell 30 of the collar 3 is formed by the portions 34A and 34B.

The blocking element 7 is equipped with mechanisms 8 for locking the blocking element in the blocking position.

The locking mechanisms 8 comprise a lever 81 rotationally articulated with the backplate 71 about an axis A8 generally perpendicular to the median plane M. The lever 81 comprises a through slot 812 for passage of a cable 82, each end of which is fixed to one of the portions 34A and 34B.

Moreover, the locking mechanisms 8 comprise two pins 85A and 85B fixed to the respective portion 34A or 34B and which, in the blocking position, are each housed in an opening 86A or 86B provided in the backplate 71. Alternatively, each portion 34A or 34B and the corresponding pin 85A or 85B pin are monobloc, that is to say, in a single piece.

The three distinct elements comprised of the blocking element 7, the lateral portion 34A, and the medial portion 34B are all articulated in relation to the lower portion 2, from different positions, in the area of the malleoli for the portions 34A and 34B and at the rear of the foot for the blocking element 7.

Figure 6:
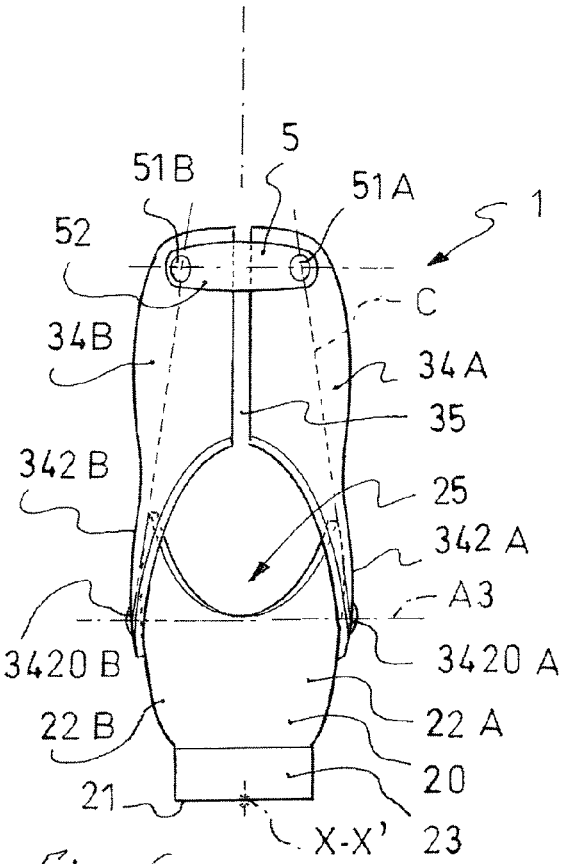
FIG. 6 is a partial rear view of the boot of FIG. 1, in the blocking position.

In the blocking position, shown in FIGS. 1, 3 and 6, the lever 81 is folded against the rear zone of the boot 1, and the pins 85A and 85B are received in the openings 86A and 86B, so as to lock the movements of the collar 3 in relation to the lower portion 2.

When the pins 85A and 85B are snugly received in the opening 86A and 86B, the assembly formed by the portions 34A and 34B, the lever 7, and the lower portion 2 are completely immobilized in relation to one another.

In the blocking position, the movements of the user's ankle are blocked. Thus, the blocking position is designed for downhill skiing, for which it is desirable to have a blocking of the ankle.

In the vicinity of the axis A8, the lever 81 comprises a projecting portion 84A forming a cam which, when the lever 81 is tilted in the unlocking position, offsets the backplate so that it is no longer in contact with the portions 34A and 34B and prevents the lever 81 from returning to the blocking position. In an alternative embodiment, not shown, the projecting portion 84A does not come directly in contact with the portions 34A and 34B, but with a spring blade which itself pushes the portions 34A and 34B. For example, within the scope of the invention, the spring blade can be fixed to the inside of the backplate, above the fixing point of the lever and to extend downward below the same point. The length of the spring blade then makes it possible to increase the amplitude of the offset between the backplate and the collar. The spring blade also energizes the lever, thereby stabilizing the open position thereof.

To switch from the blocking position to the unblocking position, the lever 81 is folded upward into an unlocking position, as indicated by the arrow F3 in FIG. 4. The projecting portions 84A and 84B press against each portion 34A and 34B, so as to push the portions 34A and 34B against the liner 4, which has the effect of pushing the pins 85A and 85B out of the openings 86A and 86B.

FIG. 4*a* illustrates an alternative construction of the boot according to the invention. A flexible blade 712 is fixed to the inner surface of the backplate 71 in the vicinity of the lever 81. In the illustrated alternative embodiment, the flexible blade 712 is metallic and fixed by a rivet 713 above the opening provided in the backplate, which allows passage of the projecting portion 84A of the lever 81.

The flexible blade 712 fulfils two separate functions. First it makes it possible to increase the lever arm of the projecting portion 84A so as to move the backplate 71 farther away from the portions 34A and 34B of the collar. Second, it assumes a spring function that forces the rotation of the lever 81.

Figure 2:
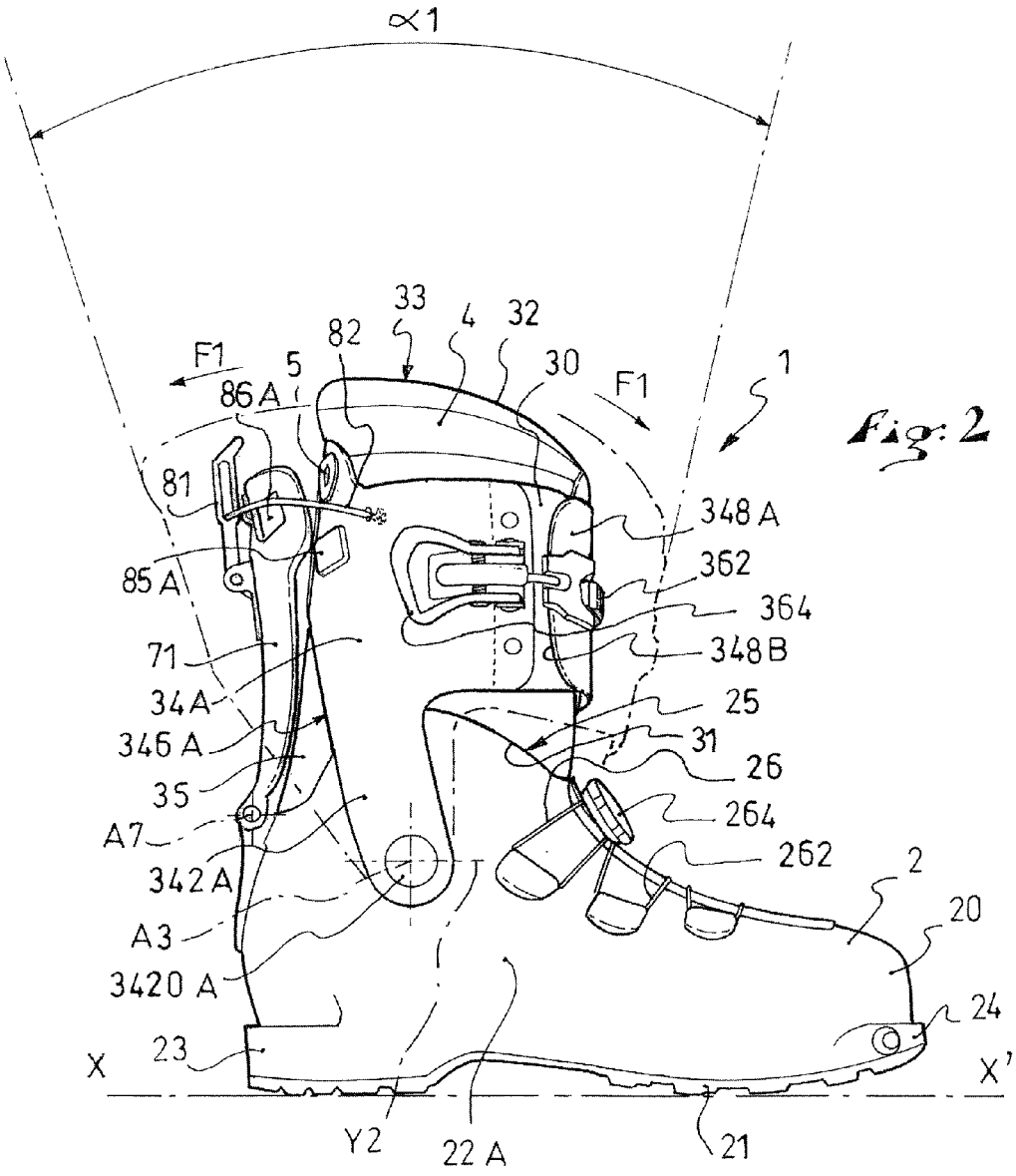
FIG. 2 is a side view of the boot of FIG. 1, in an unblocking position.

In the unblocking position, shown in FIGS. 2, 5, and 7, the pins 85A and 85B are outside of the openings 86A and 86B, so as to allow free movements of the portions 34A and 34B and of the blocking element 7, and consequently also free movements of the collar 3 with respect to the lower portion 2.

In the unblocking position, a rearward longitudinal flexional movement of the collar 3 in relation to the lower portion 2 is allowed. This rear flexional movement is represented by a first arrow F1 in FIG. 2. It is a rotation about the axis A3, perpendicular to the median plane M.

Towards the front, the longitudinal, or forward, flexional movement is limited by the physiology of the human ankle articulation, the forward flexional movement of which is limited.

Notable is an angular amplitude al of the longitudinal flexional movement of the collar 3 in relation to the lower portion 2 in the unblocking position. The angular amplitude al is greater than 50° or, in particular embodiments, greater than 60°.

Further, in the unblocking position, a lateral flexional movement F2 of the collar 3 in relation to the lower portion 2 is allowed. In the referential frame of the human foot, and in a first direction, it is a lateral flexion, and in the other direction, it is a medial flexion. The lateral flexion is a rotation about an axis Y2 parallel to the longitudinal axis X-X', located between the rivets 3420A and 3420B and included in the median plane M. The lateral flexional movement F2 is limited in both directions by the inherent rigidity of each portion 34A and 34B.

Notable is a quadrilateral-shaped contour C, the vertices of which are defined by the rivets 3420A, 3420B, 51A, and 51B. Notable are the angles γ1, γ2, γ3, and γ4 of the quadrilateral. The lower side C1 of the contour C, between the rivets 3420A and 3420B, remains fixed in both the blocking position and the unblocking position during longitudinal F1 and lateral F2 flexional movements.

The lateral flexional movement F2 movably drives the other three sides of the contour C, namely an upper side C2 generally parallel to the first side and located between the rivets 51A and 51B, a lateral side C3 located between the rivets 3420A and 51A, and a medial side C4 located between the rivets 3420B and 51B. The sides C3 and C4 are generally vertical. Thus, the values of the angles of the quadrilateral defined by the contour C vary during the lateral flexion F2.

Notable is an angular amplitude α2 of the lateral flexional movement F2 of the collar 3 in relation to the lower portion 2, on both sides of the median plane M, in the unblocking position. The angular amplitude α2 is between 10° and 30° or, in a particular embodiment, on the order of 20°.

As shown in FIG. 7, the lateral flexional movement F2 of the portions 34A and 34B is combined simultaneously with a relative translational movement T of the lateral portion 34A in relation to the medial portion 34B. The translation T is parallel to the inner edge 346A or 346B of each portion 34A and 34B. The translation T comprises a first vertical component T1 parallel to the median plane M and perpendicular to the sole 21, and a second transverse component T2 perpendicular to the median plane M. The translational movement T results from the flexion of the bearings 342A and 342B of the portions 34A and 34B. Thus, the lateral flexional movement F2 is allowed by mechanical decoupling of the portions 34A and 34B, due to the slit 35.

The unlocking position thus allows great freedom of movement of the collar 3 with respect to the lower portion 2, thereby enabling the practice of walking, for example an approach in the context of ski touring, or mountaineering.

The boot 1 is lightweight due to the structure of the blocking element 7 and of the locking mechanisms 8. Due to the structure in two portions 34A and 34B of the collar 3, the lateral flexional movements of the ankle are allowed, and the space requirement of the boot 1 is limited.

The invention is not limited to the embodiments described and illustrated. In particular, in the scope of the invention, the described embodiments and their variants can be combined, at least partially.

Further, at least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A sports boot comprising:

a lower portion designed to surround a foot of a user;

an outsole;

an upper portion designed to extend around a lower leg of the user and to be movable in relation to the lower portion;

blocking mechanisms that at least partially block movements of the lower portion in relation to the upper portion, wherein the blocking mechanisms are located at a rear of the sports boot;

the upper portion comprises a lateral portion and a medial portion, disjointed and each rotationally articulated with the lower portion;

the lateral and medial portions of the upper portion of the sports boot comprising two distinct portions separated from each other by a gap at the rear of the sports boot;

connecting mechanisms arranged in a rear zone of the sports boot, the connecting mechanisms connecting the lateral portion with the medial portion of the upper portion of the sports boot;

the blocking mechanisms comprise a blocking element movable between the following positions:

a blocking position, in which the blocking mechanisms at least partially lock movements of the upper portion in relation to the lower portion;

an unblocking position, in which the blocking mechanisms allow free movements of the upper portion in relation to the lower portion; and in the unblocking position of the blocking element, the blocking mechanisms allow a translational movement of the lateral portion in relation to the medial portion at least along a direction perpendicular to the outsole of the boot.

2. A sports boot according to claim 1, further comprising:

in the rear of the sports boot, a quadrilateral-shaped contour comprising vertices defined by:

a first articulation arrangement that articulates the lateral portion with the lower portion;

a second articulation arrangement that articulates the medial portion with the lower portion;

a third articulation arrangement that articulates the connecting mechanisms with the lateral portion;

a fourth articulation arrangement that articulates the connecting mechanisms with the medial portion;

in the unblocking position and during lateral flexional movement of the upper portion in relation to the lower portion, about an axis generally parallel to a longitudinal axis of the sports boot, values of angles of the quadrilateral vary.

3. A sports boot according to claim 2, wherein:

the connecting mechanisms comprise a band articulated at the lateral portion and at the medial portion by the third and fourth articulation arrangements, respectively.

4. A sports boot according to claim 1, wherein:

in the unblocking position of the blocking element, the following movements are allowed simultaneously:

a longitudinal flexional movement of the upper portion in relation to the lower portion about a first axis perpendicular to a longitudinal median plane of the sports boot; and a lateral flexional movement of the upper portion in relation to the lower portion about a second axis generally parallel to a longitudinal axis of the sports boot.

5. A sports boot according to claim 4, wherein:

an angular amplitude of the lateral flexional movement, on both sides of the longitudinal median plane, is between 10° and 30°.

6. A sports boot according to claim 4, wherein:

an angular amplitude of the lateral flexional movement, on both sides of the longitudinal median plane, is approximately 20°.

7. A sports boot according to claim 4, wherein:

the longitudinal flexional movement of the upper portion in relation to the lower portion about the first axis perpendicular to the longitudinal median plane of the sports boot has an angular amplitude of greater than 50°.

8. A sports boot according to claim 1, wherein:

the lateral portion and the medial portion each comprise a bearing rotationally articulated with a lateral side of the lower portion.

9. A sports boot according to claim 8, wherein:

the bearings are elongated; and a ratio, having a maximum width of each bearing as a denominator and a minimum length of the bearing as a numerator, is between 1.3 and 2.5.

10. A sports boot according to claim 8, wherein:

the bearings are elongated; and a ratio, having a maximum width of each bearing as a denominator and a minimum length of the bearing as a numerator, is substantially equal to 1.5.

11. A sports boot according to claim 1, further comprising:

locking mechanisms that lock the blocking element in the blocking position; and the blocking element comprises two openings, each designed to receive, in the blocking position, a pin fitted on the lateral portion or on the medial portion and belonging to the locking mechanisms.

12. A sports boot according to claim 11, wherein:

the locking mechanisms comprise a lever articulated with the blocking element, and a cable cooperating with the lever, the cable having a first end fixed to the lateral portion and a second end fixed to the medial portion; and in the blocking position, the lever exerts tension on the cable.

13. A sports boot according to claim 12, wherein:

the lever comprises a projecting portion forming a cam which, when the lever is folded in an unlocking position, pushes the lateral and medial portions and releases the pins from the openings.

14. A sports boot according to claim 1, wherein:

each of the lateral and medial portions is designed to surround the lower leg on an angular sector greater than or equal to 90°.

15. A sports boot according to claim 1, wherein:

the lateral and medial portions are designed to jointly surround the lower leg on an angular sector greater than or equal to 300°.

16. A sports boot according to claim 1, wherein:

the sports boot includes a liner; and the liner is visible from the rear of the sports boot between the lateral and medial portions of the upper portion.

17. A sports boot according to claim 1, wherein:

the gap is a vertical slit at the rear of the sports boot.

18. A sports boot according to claim 1, wherein:

in the unblocking position of the blocking element, a longitudinal flexional movement of the upper portion in relation to the lower portion about a first axis perpendicular to a longitudinal median plane of the sports boot has an angular amplitude of greater than 50°.

19. A sports boot according to claim 1, wherein:

in the unblocking position, the blocking mechanisms allow a rearward movement of the upper portion of the sports boot from the blocking position.

20. A sports boot according to claim 1, wherein:

the gap separating the lateral portion and medial portion of the upper portion of the sports boot is present in both the blocking position and in the unblocking position.

* * * * *